US006299800B1

(12) United States Patent
Viswanathan

(10) Patent No.: US 6,299,800 B1
(45) **Date of Patent: *Oct. 9, 2001**

(54) CONDUCTING COMPOSITIONS OF MATTER

(75) Inventor: Tito Viswanathan, Little Rock, AR (US)

(73) Assignee: The United States of America as represented by the Administrator of the National Aeronautics and Space Administration, Washington, DC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/507,092

(22) Filed: Feb. 17, 2000

Related U.S. Application Data

(60) Continuation of application No. 09/369,274, filed on Aug. 6, 1999, which is a division of application No. 09/034,063, filed on Mar. 3, 1998, now Pat. No. 5,968,417.

(60) Provisional application No. 60/040,786, filed on Mar. 3, 1997.

(51) Int. Cl.[7] ..... H01B 1/00

(52) U.S. Cl. ..... 252/500; 252/511; 528/391; 528/422; 528/424; 528/320.2; 528/210; 528/214

(58) Field of Search ..... 252/500, 511; 528/391, 422, 424, 320.2, 210, 214

(56) References Cited

U.S. PATENT DOCUMENTS 5,968,417 * 10/1999 Viswanathan ..... 252/500
6,059,999 * 5/2000 Viswanathan ..... 252/500

* cited by examiner

*Primary Examiner*—Yogendra Gupta
*Assistant Examiner*—D G Hamlin
(74) *Attorney, Agent, or Firm*—Diana M. Cox; Gary G. Borda

(57) ABSTRACT

The invention provides conductive compositions of matter, as well as methods for the preparation of the conductive compositions of matter, solutions comprising the conductive compositions of matter, and methods of preparing fibers or fabrics having improved anti-static properties employing the conductive compositions of matter.

8 Claims, 2 Drawing Sheets

CONDUCTING COMPOSITIONS OF MATTER

PRIORITY OF INVENTION

This application claims priority under 35 U.S.C. §119(e) from U.S. Provisional patent application No. 60/040,786, filed Mar. 3, 1997.

This application is a continuation of application Ser. No. 09/369,274, filed Aug. 6, 1999, a divisional of application Ser. No. 09/034,063 on Mar. 3, 1998, now U.S. Pat. No. 5,968,417. +gi

GOVERNMENT FUNDING

The invention described herein was made in the performance of work under a NASA contract and is subject to the provisions of Public Law 96-517 (35 U.S.C. §202) in which the contractor has elected not to retain title.

BACKGROUND OF THE INVENTION

Electrically conducting polymers are of great interest because of potential applications where they may replace metals and semimetals that require comparatively more energy in processing. For example, there is an interest in developing conducting polymers for use, in electronics (Sun et al. "Solution Processable Conducting Polymer: Polyaniline-Polylectrolyte Complexes," *Mat. Res. Soc. Symp. Proc.*, 1994, 328, 209–214; U.S. Pat. No. 5,370,825), as anti-static coatings for fabrics (R. V. Gregory et al. "Electrically Conductive Non-Metallic Textile Coatings," *Journal of Coated Fabrics*, 1991, 20, 1–9; in corrosion prevention (S. Sathiyanarayanan et al. "Prevention of Corrosion of Iron in Acedic Media Using Poly (o-Methoxyaniline)," *Electrochemica Acta*. 1994, 39, 831–837). in photolithography (G. Venungopal et al. "Photoinduced Doping and Photolithography of Methyl-Substituted Polyaniline," *Chem. Mater*. 1995, 7, 271–276; and in electromagnetic radiation shielding (D. C. Trivedi, S. K. Dhawan, "Shielding of electromagnetic interference using polyaniline," *Synthetic Metals*, 1993, 267–272.

One of the problems impeding the analysis and development of useful polyconjugated conducting materials is their insolubility in the conducting state. Soluble forms of some polyconjugated polymers are known, but their solubility is usually decreased or lost when the transition is made from the nonconducting to the conducting state. One example of this phenomenon is polyaniline, one of the most highly researched polyconjugated polymers, which shows poor solubility in the conducting state.

Over the past ten years, a considerable effort has been made to prepare novel, water soluble, conducting polymers. For example, U.S. Pat. No. 5,370,825 discloses a water soluble electrically conductive composition of matter comprising a polyacid and a polymer, comprising at least one conjugated region composed of repeating units incorporating a conjugated base atom. Additionally, U.S. Pat. No. 5,422,423 discloses electrically conductive conjugated polymer complexes comprising a substituted or unsubstituted positively charged conjugated polymer, doped with a dopant anion substituted with one or more anionic functionalities, and substituted with one or more hydrogen bonding groups.

Despite the considerable efforts that have been made to discover novel and useful water soluble conducting polymers, there continues to be a need for novel electrically conducting polymers with increased solubility and increased processability. There is also a continuing need for novel electrically conducting polymers that can be prepared from inexpensive materials, and for water soluble conductive polymers that are highly cross-linkable.

SUMMARY OF THE INVENTION

The present invention provides a conductive composition of matter comprising linearly conjugated π-systems and residues of a sulfonated lignin or a sulfonated polyflavonoid.

The invention also provides a conductive composition of matter comprising linearly conjugated π-systems and sulfonated polyaryl compounds, wherein the aryl rings of the sulfonated polyaryl compound are substituted with hydroxy, methoxy, ethoxy, hydroxymethyl, or 2-hydroxyethoxy substituents. Preferrably, the linearly conjugated π-systems are grafted to the sulfonated polyaryl compounds.

The invention also provides a method for preparing a water soluble conductive polymer comprising combining sulfonated lignin or a sulfonated polyflavonoid, with one or more monomers, an initiator (e.g. an oxidation catalyst), and a solvent. The invention also provides a composition of matter which is the product of the method.

The invention also provides a method for preparing a water soluble conductive polymer comprising combining: a) sulfonated polyaryl compounds, wherein the aryl rings of the sulfonated polyaryl compound are substituted with hydroxy, methoxy, ethoxy, hydroxymethyl, or 2-hydroxyethoxy substituents; b) one or more monomers; c) an initiator (e.g. an oxidation catalyst); and d) a solvent. The invention also provides a composition of matter which is the product of the method.

The invention also provides a method comprising producing a fiber or fabric with improve anti-static properties by: a) contacting the fiber or fabric with a conductive composition of matter of the invention and one or more formaldehyde-based resins; and b) curing the fiber or fabric. The invention also provides an article of manufacture (i.e. a fiber or fabric with improve anti-static properties) prepared by the foregoing method.

The invention also provides a method comprising producing a fiber or fabric with improve anti-static properties by: a) combining a conductive composition of matter of the invention with formaldehyde-based resin to form a resulting mixture; b) contacting the fiber or fabric with the resulting mixture; and c) curing a resulting fiber or fabric. The invention also provides an article of manufacture (i.e. a fiber or fabric with improve anti-static properties) prepared by the foregoing method.

The invention also provides an article of manufacture comprising: a) a fiber or fabric; and b) a conductive composition of matter of the invention associated with the fiber or fabric.

The invention also provides a solution comprising a composition of matter of the invention, in combination with water, dimethylsulfoxide, methanol, propanol, isopropanol, dimethylformamide, or ethanol, or a mixture thereof; the invention also provides a solution comprising a composition of matter of the invention and water.

The invention also provides a method for preparing lignin sulfonic acid comprising contacting a solution of a salt (e.g. the potassium, sodium, or ammonium salt) of sulfonated lignin with a cation exchange resin.

DETAILED DESCRIPTION

Figure 1:
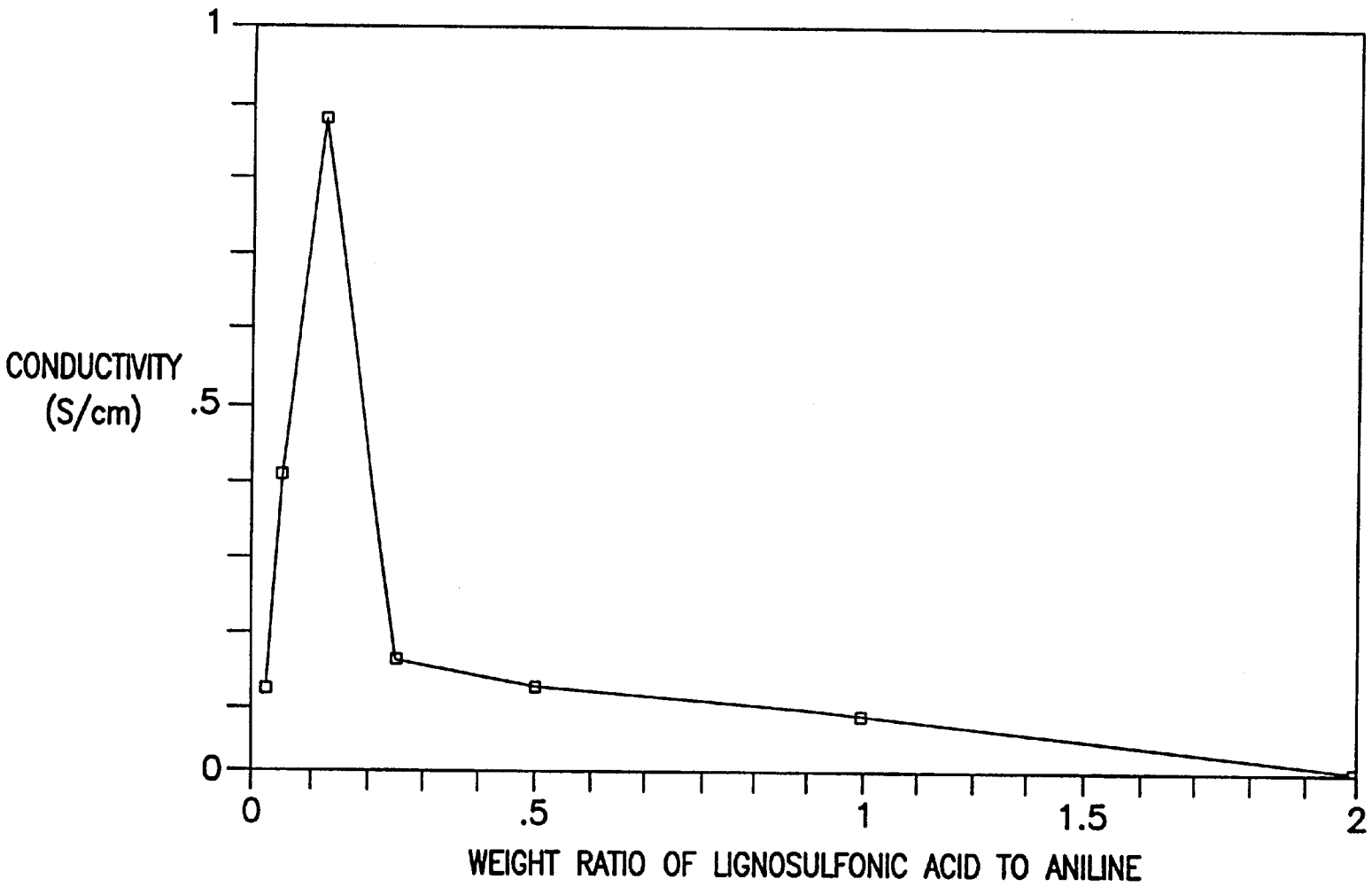
FIG. 1 shows the relation between the conductivity of Ligno-PANi and various weight ratios of lignosulfonic acid to aniline

The field of electrically conducting organic polymers is dominated by two types of molecular structures: linear conjugated π-systems and charge-transfer complexes, which form stacks of π-systems in the solid state. In linear conjugated π-systems, electrons move rapidly along a partially oxidized or reduced molecular chain. The conjugated region of an individual linearly conjugated π-system should preferably extend so that when the conjugated region of one linearly conjugated π-system is adjacent to the conjugated region of another linearly conjugated π-system, and an electric field is applied, an electron can flow from the first linearly conjugated π-system to the adjacent linearly conjugated π-system.

Examples of linear conjugated π-systems include polymers comprising substituted and unsubstituted aromatic and heteroaromatic rings (e.g. 5 or 6 membered aromatic and heteroaromatic rings). Preferably, the rings will be linked into a continuous conjugated π-electron network, such as those present in polyaromatic or poly(pseudo-aromatic) systems. For example, see U.S. Pat. No. 5,423,956 at columns 1, 4, and inter alia.

Specific linearly conjugated π-systems comprise one or more conjugated regions composed of monomeric units incorporating a conjugated "basic atom" that can form the positive part of an ionic couple. The preferred basic atom is nitrogen. Other basic atoms include sulfur. For example, linearly conjugated π-systems can be composed entirely of, or comprise, of repeating monomer units of aniline, thiophene, pyrrole, and/or phenyl mercaptan. Linearly conjugated π-systems useful in the present invention also include linearly conjugated π-systems of repeating monomer units of aniline, thiophene, pyrrole, and/or phenyl mercaptan that are ring-substituted with one or more (e.g. 1, 2, or 3) straight or branched alkyl, alkoxy, or alkoxyalkyl groups, wherein the alkyl, alkoxy, or alkoxyalkyl groups each contain from 1 up to about 10 carbon atoms, or preferably from 1 to 4 carbon atoms. Linearly conjugated π-systems that can be prepared by oxidation-type polymerization are preferred.

The linearly conjugated π-systems of the compositions of matter of the present invention can also be copolymers of any one or more of the above monomers with other co-monomers having ethylenic unsaturation, such as, ethylene, propylene, vinyl chloride, styrene, vinyl alcohol, or vinyl acetate. In such cases, the conjugated region or regions containing the basic monomeric units should comprise a block sufficiently long that the composition of matter is conductive.

A linearly conjugated π-system may comprise 3 to 100 monomer units. Preferred linearly conjugated π-systems comprises 5 to 50 monomer units, and more preferred linearly conjugated π-systems comprise 10 to 30 monomer units.

One preferred class of linearly conjugated π-systems is the polyanilines. Polyanilines have been extensively studied because of their unique chemical, electronic, and optical properties. Thus, the polyanilines represent a well known class of substances in the polymer field. For a detailed description of polyanilines, see U.S. Pat. No. 5,164,465, columns 1–3. The linearly conjugated π-systems of the composition of matter of the invention are preferably polyaniline chains. Other preferred classes of linearly conjugated π-systems are the polypyrroles (A. F. Diaz et al. *J. Chem Soc. Chem. Commun.*, 1979, 635, 854; and G. Tourilion et al. *J. Phys. Chem.*, 1987, 87, 2289), and the polythiophenes (G. Tourilion *J. Electroanal. Chem.* 1984, 161, 51).

Lignin is a principal constituent of the wood structure of higher plants, and ranks second to cellulose as the most abundant organic material. Lignin from coniferous trees is a polymeric substance resulting from the random combination of the products of an enzymatically induced oxidation (dehydrogenation) of coniferyl alcohol. In deciduous trees, lignin comprises structures from the polymerization of both coniferyl alcohol and sinapyl alcohol. Additionally, the lignin polymer may comprise functional groups such as hydroxy, methoxy, and carboxy groups. See "Kirk-Othmer Concise Encyclopedia of Chemical Technology;" A Wiley-Interscience publication; 1985; page 699; Abridged version of the 24 volume Encyclopedia of Chemical Technology. 3rd ed. New York: Wiley, c1978–c1984; executive editor Martin Grayson.

The sulfite process of the paper and wood-pulp industries yields a spent liquor that comprises sulfonated lignins (i.e. lignosulfonates). Lignosulfonates are used as dispersants, binders, emulsion stabilizers, complexing agents, and for other applications. Lignosulfonates are abundant, inexpensive polyaryl-sulfonic acids that are highly soluble in water. The aryl rings of lignosulfonate polymers may comprise a variety of functional groups (e.g. hydroxy, methoxy and carboxy groups) that can be cross-linked, after polymerization. Additionally, lignosulfonates comprise multiple sulfonic acid groups that can be used for doping polymers. Lignosulfonates can also be readily converted into their corresponding sulfonic acid derivatives, which are disclosed herein to be useful templates and reagents for oxidative polymerization reactions.

Lignosulfonates are available from a number of commercial sources. In general, lignosulfonates from any source can be used to prepare the compositions of matter of the invention provided they are free of impurities that interfere with polymerization reaction conditions. Specifically, "Lignosulfonic acid, ethoxylated, sodium salt (CAS Registry Number 68611-14-3, "REAX 825E")," available as REAX 825E from Westvaco, Chemical Division, Polychemicals Department, P.O. Box 70848, Charleston Heights, S.C. 29415-0848, can be used to prepare the compositions of matter of the invention. REAX 825E has the chemical formula: $[(CH_3O)(HOC_2H_4O)Ar(CH_2SO_3Na)_x(C_3H_5SO_3Na)_y]_z$. "Ammonium Lignosulfonate; WANIN AM (Powder) (CAS Registry Number 8061-53-8, "WANIN")" available from LIGNOTECH USA, INC., Research and Development, 100 Highway 51 South, Rothchild, Wis., 54474-1198, can also conveniently be used to prepare the compositions of matter of the invention.

Another class of polyaryl-sulfonic acids that are readially available and highly water soluable are the sulfonated polyflavanoids (e.g. sulfonated condenced tannins). Condensed tannins are used extensively in the commercial preparation of adhesives and resins (Wood Adhesives: Chemistry and Technology; A. Pizzi; Marcel Dekker, Inc., New York, (1983), chapter 4). Sulfonated polyflavonoids like lignosulfonate, comprise polyaryl rings that comprise a variety of functional groups that can be cross-linked after polymerization. In particular, sulfonated polyflavonoids have a polyhydroxylated-sulfonated-polyaryl ring structure that make them ideal templates and reagents for preparing the compositions of matter of the invention.

The sulfonated lignins and sulfonated polyflavonoids share common structural features that make them especially useful for preparing the compositions of matter of the invention. It is understood that preferred reagents for preparing the compositions of matter of the invention comprise substituted sulfonated polyaryl rings. Thus, it is understood that, in general, sulfonated-polyaryl compounds, wherein the aryl rings are substituted with hydroxy, methoxy, ethoxy, hydroxymethyl, or 2-hydroxyethoxy substituents can be used as a templates or reagents for preparing the compositions of matter of the invention.

Within the compositions of matter of the invention, the sulfonated polyaryl compounds (e.g. the sulfonated lignins or sulfonated polyflavonoids) can be attached to the linearly conjugated π-systems by ionic or covalent bonds, as well as through electrostatic interactions (e.g. hydrogen bonds). Thus, the term "residue of," as used herein with respect to a sulfonated polyaryl compound, comprises a radical and/or an ion of the sulfonated polyaryl compound that is attached (ionically, covalently, or electrostatically), at one or multiple sites, to one or more linearly conjugated π-systems.

The molecular weight of the compositions of matter of the present invention can vary over a large range and may be virtually any value, depending on the desired application. Thus, the compositions of matter of the invention may have a molecular weight on the order of about 5000 to 200,000. Specific compositions of matter may have a molecular weight on the order of about 10,000 to 100,000; and preferred compositions of matter of the invention have a molecular weight of about 15,000 to 50,000.

The preparation of the compositions of matter of the invention can conveniently be carried out by combining a sulfonated lignin or a sulfonated polyflavonoid, with the desired monomer (or co-monomers), an effective amount of an initiator, and a solvent.

The monomer can be selected with regard to the desired final polymer. Suitable monomers include aniline, o-ethylaniline, m-ethylaniline, o-ethoxyaniline, m-butylaniline, m-hexylaniline, m-octylaniline, 4-bromoaniline, 2-bromoaniline, 3-bromoaniline, 3-acetamidoaniline, 4-acetamidoaniline, 5-chloro-2-methoxyaniline, 5-chloro-2-ethoxyaniline, 2,5-dimethylaniline, 2,3-dimethylaniline, 2,5-dibutylaniline, 2,5-dimethoxyaniline, tetrahydronaphthylamine, 2-cyanoaniline, 2-thiomethylaniline, 3-(n-bytanesulfonic acid)aniline, 2,4-dimethoxyaniline, 4-mercaptoaniline, 4-methylthioaniline, 3-phenoxyaniline, 4-phenoxyaniline, thiophene, pyrrole, and thiophenol. Preferred monomers useful in the methods of the invention include aniline, o-methoxyaniline, and o-ethoxyaniline. Another preferred monomer is pyrrole.

Suitable solvents include polar liquids in which lignosulfonic acid, the monomer, and the final composition of matter are soluble. Examples of suitable solvents include water or alkanols (e.g. methanol, ethanol, propanol, and isopropanol), or any combination thereof. A preferred solvent is water.

Suitable initiators include any material capable of initiating the oxidation polymerization, for example, hydrogen peroxide, iron trichloride, potassium permanganate, potassium persulfate, and other such oxidizing agents. When the monomer to be polymerized is an aniline, the preferred initiator is ammonium persulfate.

The polymerization reactions can be carried out at a suitable temperature, for example, a temperature in the range of about −10 to 100° C. Preferably, the polymerization is carried out at a temperature in the range of about 0 to 30° C., and more preferably, at about 0 to 5° C.

The polymerization reaction can conveniently be carried out using monomers and sulfonated aryl polymers in a wide range of weight ratios. Conveniently, approximately a (1–5):1 weight ratio of sulfonated aryl polymer and monomer can be used (e.g. a 1:1 ratio). As shown in Example 3, however, for the preparation of the composition of matter comprising lignosulfonic acid and polyaniline chains, higher conductivities were obtained when lignosulfonic acid and aniline were combined in a 0.125:1 weight ratio. It may be preferred to carry out the polymerization reaction using about, a (0.01–1):1, or preferrably about a (0.1–0.5):1, weight ratio of lignosulfonic acid to monomer. In general, the higher the relative concentration of lignosulfonic acid, the greater the solubility of the resulting composition of matter.

It has unexpectedly been found and it is disclosed herein that sulfonated lignin and sulfonated polyflavonoids are useful templates for carrying out polymerization reactions yielding conducting composition of matters comprising conjugated π-systems. Sulfonated lignin and sulfonated polyflavonoids are superior to previously known polymerization templates due to their very high solubility in water, their cross-linkability, their relative abundance, their low cost, and because of the availability of the pendent sulfonic acid groups for doping the resulting polymers.

It has also unexpectedly been found that novel compositions of matter can be prepared which comprise conjugated π-systems that are grafted (i.e. covalently bonded) to sulfonated lignin or a sulfonated polyflavonoids. While not wishing to be bound by theory, it is believed that this grafting results from the formation of radical species of the sulfonated polymers, which subsequently initiate aniline polymerization, and are thereby covalently incorporated into the resulting compositions of matter. It is believed that sulfonated polymers bearing aryl-hydroxy groups (e.g. lignin sulfonic acid and sulfonated polyflavonoids), are particularly likely to form grafted products. There have been no previous reports of conducting compositions of matter comprising conjugated π-systems grafted to sulfonated lignin or a sulfonated polyflavonoid. Thus, the compositions of matter of the invention are novel.

Additionally, because the sulfonated lignin or sulfonated polyflavonoids are incorporated into the reaction product, the compositions of matter of the invention possess unexpected and advantageous properties over previously disclosed conductive compositions of matter. For example, the compositions of matter of the invention comprising polyaniline chains grafted to sulfonated lignin or sulfonated polyflavonoids are highly cross-linkable due to the presence of the sulfonated lignin or sulfonated polyflavonoids, which are substituted with a variety of functional groups. Thus, the compositions of matter of the invention may be especially useful to prepare corrosion resistive coatings for metals, and to prepare anti-static coatings for fibers or fabrics.

As disclosed above, the invention provides a method comprising producing a fiber or fabric with improve anti-static properties by: a) contacting the fiber or fabric with a conductive composition of matter of the invention and one or more formaldehyde-based resins; and b) curing the fiber or fabric.

The term "a fiber or fabric with improved anti-static properties" means a fiber or fabric that has anti-static properties that are improved to a statistically significant and measurable degree over the plain fiber or fabric (i.e. the fiber or fabric prior to being treated using the method of the invention).

The term formaldehyde-based resin is well known and understood in the art, and includes melamine-formaldehyde resin, phenyl-formaldehyde resin and urea-formaldehyde resin. The method can conveniently be carried out using a variety of ratios of conductive composition of matter to formaldehyde-based resin. Preferrably, a weight ratio of conductive composition of matter to formaldehyde-based resin of (0.25–4):1 can be used. More preferrably, a ratio of about 1:1 can be used.

Suitable fibers or fabrics include any fabric or fiber that is stable under the curing conditions employed. For example, cotton, polyester, wool and nylon fibers or fabrics, as well as other common fibers or fabrics are suitable.

The term "contacting the fiber or fabric with a conductive composition of matter of the invention and one or more formaldehyde-based resins" contemplates any method of bring the fiber or fabric together with the conductive composition of matter of the invention and the resin. For example, the fiber or fabric can conveniently be dipped into a mixture comprising a composition of matter of the invention, a resin, and a solvent; or such a mixture can be sprayed or aspirated onto the fiber or fabric. A resulting fiber or fabric may be externally coated with the mixture, or the mixture may be present in the internal matrix of the fiber or fabric.

"Curing" may be performed by any suitable curing procedure, however, thermal curing procedures, wherein the fiber or fabric is heated to a sufficient temperature to cause a chemical reaction between the composition of matter of the invention and the formaldehyde-based resin are preferred. For example, the curing may conveniently be carried out at a temperature in the range of 50 to 200° C. (preferrably 100–130° C.), for a time period of 0.1 hours to 24 hours (preferrably 0.25 to 1 hour).

As discussed above, the invention also provides an article of manufacture comprising: a) a fiber or fabric; and b) a conductive composition of matter of the invention associated with the fiber or fabric. As used herein, the term "associated" includes the conductive composition of matter of the invention being attached to the fiber or fabric in any manner. For example, the conductive composition of matter of the invention can be externally coated on the fiber or fabric or incorporated into the internal matrix of the fiber or fabric.

The invention will now be illustrated by the following non-limiting Examples wherein unless otherwise stated: IR spectra were done as KBr pellets using a Perkin-Elmer 1600 FT-IR spectrometer; $^1$H-FT-NMR spectra were obtained using a Bruker AC-F 200 MHZ instrument; UV-Vis spectra were obtained using a Perkin-Elmer Lambda Array 3840 spectrophotometer; and conductivity was measured using a standard four-point probe method (Alessi).

EXAMPLES

Example 1

A solution of 2.5 grams of an ammonium salt of sulfonated lignin (Wanin, Lignotech USA) in 32.24 milliliters of deionized water was poured over a Dowex HCR-W2 cation exchange column (Aldrich Chemical Company, Inc. Milwaukee Wis., Cat no. 42,870-1) to replace the ammonium ions with protons. The resulting 2.5 g of lignin sulfonic acid aqueous solution was introduced into a beaker which was placed in a 0° C. ice bath. One milliliter of aniline or pyrrole was poured into the stirring lignin solution. A solution of 2.4 grams of ammonium persulfate in deionized water was slowly dripped into the aniline/(ligninsulfinic acid) or pyrrole/(lignin sulfonic acid) solution. The solution was stirred at 0° C. for two hours and then allowed to warm to room temperature over 1 hour.

The above synthetic method was repeated, except the Wanin ammonium salt of sulfonated lignin was replaced with ethoxylated lignin (REAX 825E, Westvaco).

The resulting products were centrifuged, with acetone followed by water, the supernatant was discarded, and the remaining solids were dried in a vacuum oven overnight. The powders obtained were pressed into pellets of pure polymer and the conductivities were measured via a four-point conductivity probe (Alessi). FTIR Infrared spectra were also collected from pressed KBr pellets of the products.

The water and DMSO soluble fractions of the polymers were characterized with UV-Vis spectrometry, cyclic voltammetry, and $^1$H and $^{13}$C NMR spectrometry. Solubilities and solution colors produced by the polymers in various solvents (deionized water, methanol, 1.5 M HCl, 3% $NH_4OH$, acetone, DMSO, saturated lithium chloride, and combinations of these as solvents) were also examined.

In the case of the polyaniline-lignosulfonic acid synthesis, an emerald green water-borne polymer was produced. Following centrifugation, the dried polyaniline/Wanin and polyaniline/REAX 825E powders were pressed into pellets and the conductivities were measured. The conductivities were $1.0\times10^{-2}$ and $3.8\times10^{-1}$ S/cm, respectively.

With polypyrrole reactions, black powders were obtained after drying. The polypyrrole/Wanin polymer product had a measured conductivity of $5.0\times10^{-2}$ S/cm and the polypyrrole/REAX 825E polymer product had a conductivity of $1.0\times10^{-2}$ S/cm.

Infrared spectra were collected for all four polymer products. For spectral comparisons, infrared spectra of pressed KBr pellets of pure Wanin and REAX 825E were obtained. It was found that numerous peaks from the lignin template overlapped with those of the polymer. However, the spectra for the polyaniline had peaks at 1301 cm$^{-1}$, 1034 cm$^{-1}$ and 804 cm$^{-1}$ that are not present in the lignin spectrum; these peaks match peaks in spectra of pure polyaniline (see Y. Wei et al. *Macromolecules*, 1990, 23, 758–764). The spectra for the polypyrrole product has peaks at 1536 cm$^{-1}$, 1295 cm$^{-1}$, and 964 cm$^{-1}$ that are not obscured by the lignin peaks; these peaks match peaks in the spectra of pure polypyrrole (see T. H. Chao and J. March, *Journal of Polymer Science: Part A: Polymer chemistry*, 1988, 26, 743–753).

$^1$H NMR spectra were collected for Wanin and REAX 825E for spectral comparison to ensure that no or insignificant overlap was occurring. The $^1$H NMR of the polyaniline/Wanin product in a solution of lithium chloride and DMSO shows four peaks at 7.7, 7.5, 7.4, and 7.2 ppm which are indicative of aromatic protons. These peaks are completely absent in Wanin and REAX 825E starting materials, probably due to the fact that all aromatic sites are sulfonated. The only observable peak near the aromatic region due to the lignin derivatives is at 6.4 ppm. The solution was green in color which suggested that the polyaniline was in a conducting (doped) state. It was found that if the polymer was obtained by addition of excess acetone to the reaction mixture and precipitated, the polymer will produce a green solution in deionized water or methanol, and a blue solution in DMSO. If water or methanol is added to the blue DMSO solution it readily turns green, and vice versa. $^1$H NMR spectra were obtained for the (blue) DMSO solution and then for the DMSO solution with two drops of methanol added to it which changed the solution to a green color.

In the blue DMSO solution, the aromatic protons show up in a broad band centered at approximately 7.0 ppm. After the methanol was added, the aromatic protons were shown to be four singlet peaks at 6.8, 7.1, 7.3, and 7.8 ppm.

The color change phenomenon was examined by further UV-Vis and cyclic voltammetry studies. It was found that neither of the lignin samples used in this study contributed to the visible portion of the spectrum. UV-Vis spectra were collected from a blue DMSO solution of the polymer, and then from the subsequent addition of methanol. There was a significant shift of intensity and position of the bands in the visible portion of the spectrum as the methanol was added and the solution color changed from blue (with a λ max at 620 nm) to green (with λ max values at 420 nm and 900 nm). These maxima closely match those published in the literature for dedoped and doped polyaniline (see J. Yie et al. *J. Am Chem Soc.* 1991, 113, 2665–2671). These results are also consistent with data derived from systems which are being influenced by the Donnan effect (see S. Ghosh and V. Kalpagam, *Indian J. Chem.*, 1992, 31, 338–341. It was also found during cyclic voltammetry studies of the polyaniline/REAX 825E product, with tetraethyl-ammonium perchlorate (TEAP) as the supporting electrolyte, that the oxidation and reduction potentials for the polymer dissolved in DMSO occur at approximately the same value which is 0.25 volts.

Testing of the color of the polypyrrole products in acidic and basic media proved to be quite interesting. The soluble fraction of polypyrrole/lignin is green in deionized water and in acid. When sodium hydroxide was added to the polypyrrole/lignin solutions, the color shifted from green to blue. This indicates that polypyrrole (in the conducting form) is soluble and that dedoping and further doping by base and acid, respectively alters the λ max of the polymers.

Example 2

Lignosulfonates were protonated via ion exchange prior to use. A polyaniline-lignosulfonate complex was made by dissolving aniline in a lignosulfonic acid solution on ice followed by the addition of an ice cold ammonium persulfate solution. After stirring for 3 hours at room temperature, a volume of acetone was added to precipitate the polymer which was then separated by centrifugation. The collected green polymer was dried under vacuum at ambient temperature. The $^1$H-FT-NMR spectra for the polyaniline complex were obtained by dissolving the material in deuterated DMSO followed by successive additions of $D_2O$ using a Bruker AC-F 200 MHZ instrument. The UV-Vis spectra were obtained by dissolving the polyaniline complex in DMSO followed by successive additions of aliquots of water using a Perkin-Elmer Lambda Array 3840 spectrophotometer.

The $^1$H-NMR spectrum of polyaniline-lignosulfonic acid in $d_6$-DMSO showed a broad peak centered near 7.0 ppm and a multiplet at 7.2–7.5 ppm characteristic of emeraldine base aromatic protons, and and peaks at 6.3 and 5.7 ppm due to primary amines. These less intense peaks are attributed to a slight doping effect of the lignosulfonic acid. The polyaniline complex was green but turned blue upon dissolution in DMSO. $D_2O$ was added in small increments to the blue solution for the subsequent spectra. As more $D_2O$ was added, the pair of multiplets shifted downfield and grew more intense with respect to the broad emeraldine base peak, which flattened out and broadened considerably. The multiplets appear as a pair of triplets but shift closer and downfield when more $D_2O$ was added. The solutions for the latter two spectra were green. Increased noise was also a trend for these spectra as the solutions became more green. The multiplet peaks are attributed to aromatic protons on doped polyaniline. These aromatic peaks do not reflect the aromatic proton peaks for the lignosulfonic acid.

The UV-Vis spectra were obtained using a sample preparation method similar to that used for the NMR spectra. For the polymer in pure DMSO, the spectrum showed a peak centered at 628 nm characteristic of dedoped polyaniline. As more water was added to the solution, the 628 nm peak decreased and a peak with an apparent maximum at 880 nm grew in intensity. After the solution reached a water:DMSO (40:60) composition, no further effect of added water was apparent.

The insolubility of the solid doped polyaniline is believe to be an effect of the polymer complex conformation rather than the lack of sufficient hydrophilic character to solubilize the polymer. Zheng, W. Et al. *Polymer Preprints*, 1995, 36, (2), 73–4, have discussed the spectroscopic changes associated with conformation effects in doped polyaniline. They found that fully doped polyaniline was dedoped sufficiently by water to produce a highly conducting polymer, and that this was associated with a change in conformation from a coil to a more linear expanded coil. This change in conformation could explain why the polyaniline-lignosulfonic acid complex is not directly soluble in water. In this system, the polyaniline begins in the extended chain or rigid rod conformation, and is insoluble. When DMSO is used as a solvent, it dedopes the polymer by hydrogen bonding to the hydrogen of the protonated imine, thus weakening its doping effect. The polyaniline chain may then relax, and the polymer complex is dedoped and solubilized. When water is introduced, the DMSO forms hydrogen bonds with the water, loosening its hold on the acidic hydrogen. This facilitates the lignosulfonic acid to redope the polyaniline, observed as the return of the green color. The dedoped and redoped polyaniline spectra are not unlike the spectra obtained for regular polyaniline (see L. Sun et al. *Polymer Preprints*, 1992, 33, (2) 379–80).

The IR spectrum of green lignosulfonic acid doped polyaniline contains peaks characteristic of doped polyaniline at 825, 1140, 1306, 1490, and 1580 $cm^{-1}$, as well as peaks at 1040 and 617 $cm^{-1}$ due to the presence of sulfonate functional groups from the lignosulfonic acid.

The conductivity of pressed pellets of the lignosulfonic acid doped polyaniline was found to be $5\times10^{-1}$ S/cm at this level of doping.

The polyaniline-lignosulfonic acid complex was found to be soluble in water only after the polymer system underwent a change in conformation brought on by dedoping with DMSO. The polymer could then be redoped by the lignosulfonic acid present with the addition of water, while retaining its solubility. This could be reversed by the addition of more DMSO.

Example 3

Lignin sulfonic acid ("$LSO_3H$") was prepared by passing a solution of 1 g of lignosulfonic acid, ethoxylated, sodium salt (REAX 825E, Westvaco USA) in 10 mL deionized water through a protonated Dowex-HCR-W2 cation ion-exchange column which was washed to pH 7 prior to use. A 1 g sample of the resulting $LSO_3H$ was added to 1 mL of aniline to form the sparingly soluble anilinium-lignosulfonate salt which was dissolved in water, cooled to 0° C. or below and oxidatively polymerized in the presence of 1.8 grams of ammonium persulfate. After three hours at 0° C., green colored water-borne conducting lignosulfonic acid doped polyaniline (Ligno-PANi) was formed. This product was further washed with water and centrifuged to remove the free lignosulfonic acid and ammonium sulfate.

The Ligno-PANi was dried under vacuum overnight. FT-IR spectra was collected using a Nicolet Magna 550 spectrometer from pressed KBr pellets; UV-Vis spectra was obtained using a Perkin Elmer Lambda 19 spectrometer; and NMR spectra was obtained using DMSO-$d_6$ as the solvent.

FIG. 1 shows the relationship between conductivity of Ligno-PANi vs w/w ratio of $LSO_3H$:aniline in the reaction mixture. The weight ratio of (0.125 g):(1 g) gave the maximum conductivity of 0.9 S/cm. Above this concentration, $LSO_3H$ acts as an impurity and below this concentration it acts as a dopant. A weight ratio of 1:1 $LSO_3H$ to aniline was determined to give a conductivity of $10^{-1}$ S/cm in addition to good water miscibility.

The IR spectrum of the starting lignosulfonic acid, ethoxylated, sodium salt (REAX 825E, Westvaco USA) has peaks at 3400 $cm^{-1}$, due to to OH stretching in phenols; 1715 $cm^{-1}$, due to the carbonyl stretching; 1180 $cm^{-1}$, due to the S═O stretching in sulfonic acids; 1213 $cm^{-1}$ and 1041 $cm^{-1}$, due to C—O—C stretching; and 555 $cm^{-1}$, due to $SO_2$ scissoring.

In addition to the peaks for the starting lignosulfonic acid, ethoxylated, sodium salt (REAX 825E, Westvaco USA), the IR spectrum of Ligno-PANi has peaks at 1598 and 1495 $cm^{-1}$ due to quinoid and benzenoid ring stretching; at 1130 $cm^{-1}$, due to C—N stretching in secondary amines; and at 743 $cm^{-1}$, due to NH deformation in secondary amines.

Changes associated with dedoping and redoping of Ligno-PANi were seen in the $\lambda_{max}$ in the UV-Vis spectra. In all spectra there was an absorption at 280 nm corresponding to the aromatic ring absorption in the lignosulfonic acid. Doped Ligno-PANi also has absorptions at 430 nm and 840 nm from the benzenoid and quinoid ring absorption in the PANi chain. On dedoping, these absorption peaks shift to 320 nm (shoulder) and 580 nm respectively. Addition of HCl was found to redope PANi and shifts the peaks back to 430 nm and 840 nm.

Spectroscopic analysis of the Ligno-Pani also demonstrates that PANi chains are grafted to the lignosulfonic acid residue. Ligno-PANi was dedoped using ammonium hydroxide and then subjected to soxhlet extraction with water followed by methanol. Low molecular weight PANi oligomers were removed using methanol. Ammonium lignosulfonate formed after dedoping is soluble in water and hence should have been extracted.

If PANi was not grafted to lignosulfonate, the spectrum for the soxhlet extracted material should not show any peaks for lignosulfonate. But the UV-Vis and NMR spectra show evidence that confirms the grafting of PANi to lignosulfonate in the product.

The UV-Vis spectrum of soxhlet extracted Ligno-PANi had an absorption peak at 280 nm corresponding to the aromatic ring absorption of lignosulfonate. In addition to the above peak, benzenoid and quinoid ring absorption peaks were present at 350 and 620 nm respectively.

Figure 2:
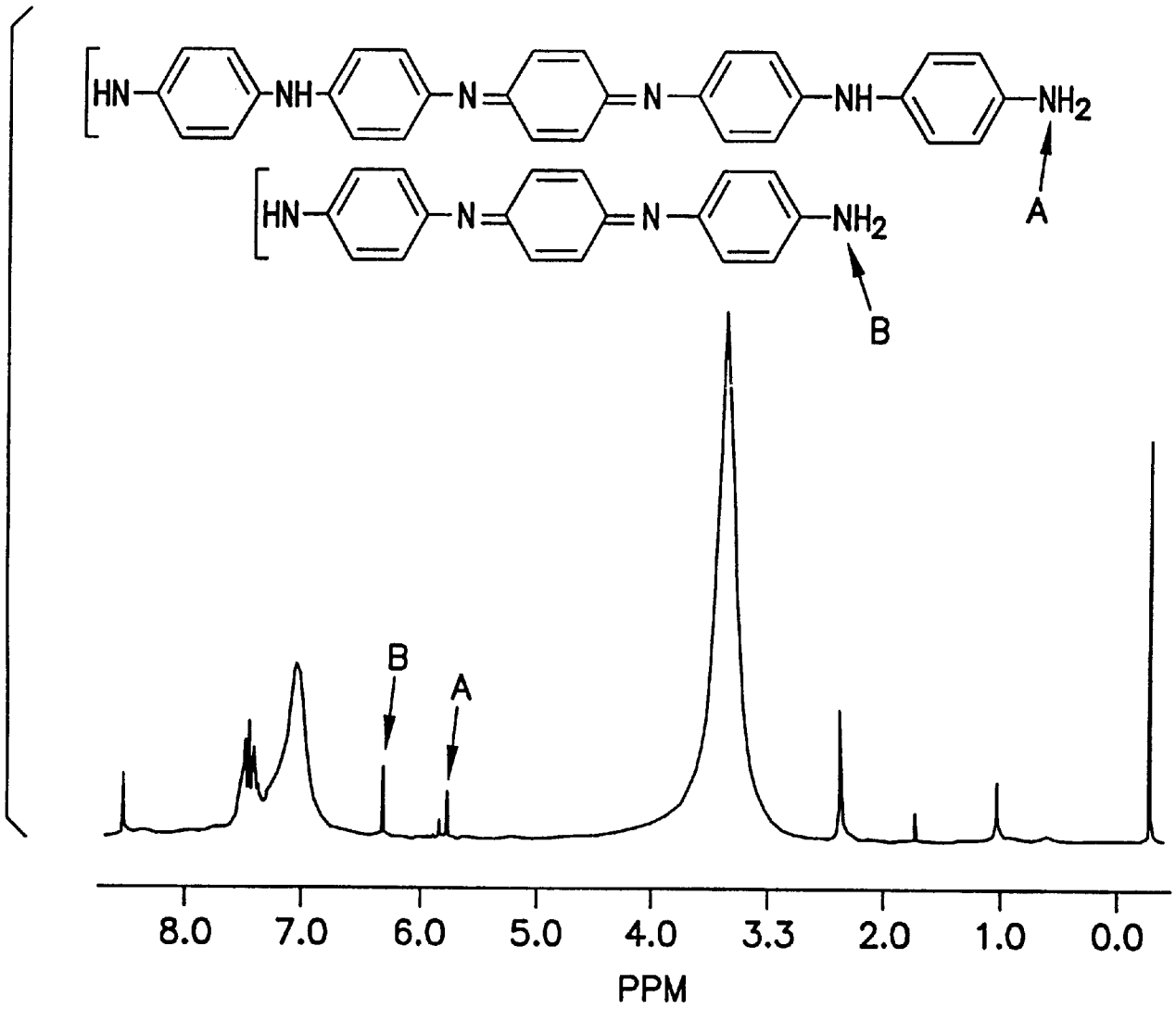
FIG. 2 shows the NMR spectrum of soxhlet extracted base form of Ligno-PANi.

Additionally, the NMR spectrum (FIG. 2) shows a peak at 1.5 ppm corresponding to the alkyl side chain in lignosulfonate. The NMR spectrum also has peaks at 5.7 ppm corresponding to the primary amine A, attached to a benzene ring which is adjacent to a secondary amine attached to another benzene ring. The peak at 6.3 ppm corresponds to the primary amine B, attached to a benzene ring adjacent to an imine nitrogen attached to a quinoid ring. The broad peak at 7.0 ppm is due to the protons on the benzene ring and the multiplet at 7.2–7.5 ppm is due to the quinoid ring protons. The ratio of benzenoid to quinoid protons peak area indicates that there are three benzene rings for one quinoid ring. The ratio of benzenoid plus quinoid protons peak area to that of the sum of the two primary amines indicate that the average chain length for PANi is 16 units corresponding to an $M_n$ of 1440.

A composition of matter was prepared comprising polyaniline, grafted to lignosulfonic acid. Characterization of (doped) ligno-PANi was possible due to its water compatibility and DMSO solubility. The conductivity of a typical (self-doped) ligno-PANi preparation is $10^{-1}$ S/cm which is adequate for applications such as corrosion prevention and anti-static charge dissipation.

Example 4

Lignosulfonic acid polyaniline (prepared as described in Example 3) was added to melamine-formaldehyde HMMM 735R resin (Monsanto Chemical Company, Saint Louis, Miss., USA) at different relative weight ratios (a 1:1 weight ratio was preferred), and the mixture was blended on a watch glass. The blend was diluted with deionized water to aid coating. The fabric was immersed in the blend for a few minutes and then cured at 120° C. for 90 minutes. Static charge build-up was significantly reduced for coated fabrics as compared to plain fabrics based on measurements with an anti-static meter.

All publications, patents, and patent documents are incorporated by reference herein, as though individually incorporated by reference. The invention has been described with reference to various specific and preferred embodiments and techniques. It should be understood, however, that many variations and modifications may be made while remaining within the spirit and scope of the invention.

What is claimed is:

1. A method for preparing a water soluble conductive polymer comprising combining a lignosulfanic acid and a polyanyline with one or more monomers, an initiator, and a solvent, wherein the weight ratio of the lignosulfanic acid to the monomer is from about (0.01–1):1.

2. The method of claim 1 wherein the weight ratio of the lignosulfanic acid to the monomer is from about (0.1–1):1.

3. The method of claim 1, wherein the weight ratio of the lignosulfanic acid and the polyanyline is from about 0.125:1.

4. A method for preparing a water soluble conductive polymer comprising combining a sulfonated aryl polymer with one or more monomers, an initiator, and a solvent, wherein the weight ratio of the sulfonated aryl polymer to the monomer is from about (1–5):1.

5. A method for producing a fiber or a fabric comprising:

contacting a fiber or a fabric with a water soluble conductive polymer comprising combining a lignosulfanic acid and a polyanyline with one or more monomers, an initiator, and a solvent, wherein the weight ratio of the lignosulfanic acid to the monomer is from about (0.01–1):1; and curing the fiber or fabric.

6. The method of claim 5, wherein the weight ratio of the lignosulfanic acid to the monomer is from about (0.1–1):1.

7. The method of claim 5, wherein the weight ratio of the lignosulfanic acid and the polyanyline is from about 0.125:1.

8. The method of claim 5, wherein the weight ratio of the sulfonated aryl polymer to the monomer is from about (1–5):1.

* * * * *